US006062938A

United States Patent [19]

Meng-Suen

[11] Patent Number: 6,062,938

[45] Date of Patent: May 16, 2000

[54] MAGNETICALLY DRIVEN ANIMATED DISPLAY

[75] Inventor: Huang Meng-Suen, Kowloon, The Hong Kong Special Administrative Region of the People's Republic of China

[73] Assignee: Mr. Christmas, Inc., New York, N.Y.

[21] Appl. No.: 08/731,194

[22] Filed: Oct. 7, 1996

[51] Int. Cl.[7] ..... A63H 33/26; G09F 19/00

[52] U.S. Cl. ..... 446/134; 446/132; 446/136; 40/426; 463/61

[58] Field of Search ..... 446/133–136, 446/139, 129, 236; 40/426; 463/61

[56] References Cited

U.S. PATENT DOCUMENTS

| | | | |
|---|---|---|---|
| 1,323,902 | 12/1919 | Obolewicz | 40/415 |
| 1,608,353 | 11/1926 | Zaikine | 446/139 |
| 2,282,430 | 5/1942 | Smith | 446/136 |
| 2,471,002 | 5/1949 | Mohr | 46/45 |
| 2,645,880 | 7/1953 | Richter | 46/45 |
| 2,942,378 | 6/1960 | Ellis | 46/149 |
| 3,103,360 | 9/1963 | Miller et al. | 273/86 |
| 3,143,826 | 8/1964 | Ellis | 446/136 |
| 3,510,949 | 5/1970 | Christy | 33/27 |
| 3,823,941 | 7/1974 | Ochi et al. | 446/136 |
| 3,908,307 | 9/1975 | Jacobson | 40/426 |
| 4,177,592 | 12/1979 | Ruck | 40/426 |
| 4,637,152 | 1/1987 | Roy | 40/495 |
| 4,644,809 | 2/1987 | Howse | 74/25 |
| 4,838,825 | 6/1989 | Hwang et al. | 446/136 |
| 5,435,086 | 7/1995 | Huang | 40/426 |

FOREIGN PATENT DOCUMENTS

| | | | |
|---|---|---|---|
| 1121585 | 8/1956 | France | 40/426 |

*Primary Examiner*—Robert A. Hafer
*Assistant Examiner*—Laura Fossum
*Attorney, Agent, or Firm*—Fitzpatrick, Cella, Harper & Scinto

[57] ABSTRACT

An animated display for use with magnetically-attractable, movable figurines includes a display surface and a magnet for attracting one of the figurines across the display surface. A drive mechanism is provided for intermittently moving the magnet in a closed path below the display surface. The figurines can pivot to simulate motion as they move across the display surface.

36 Claims, 7 Drawing Sheets

MAGNETICALLY DRIVEN ANIMATED DISPLAY

BACKGROUND OF THE INVENTION

1. Field of the Invention

The present invention relates generally to an animated display device having figurines that are moved over a display surface by magnetic forces. More particularly, the present invention relates to a magnet drive system and at least one figurine which is moved in intermittent motions over the display surface.

2. Description of the Prior Art

Magnets have long been used to move figurines over display surfaces. Typically, a display surface of a toy will be formed to represent some type of recreational area such as, for example, a skating rink, a race track, etc., on which figurines such as ice skaters or race cars move about. One or more magnets will be supported for movement just beneath the display surface. As the magnetic force attracts the figurine, the figurine will move over the display surface as it follows the magnet.

Along with many different kinds of display surfaces, many types of drive systems for moving the magnets below the display surface have been proposed through the years. For instance, a combination of planetary and sun gears can be provided to cause elongated magnet supports to revolve about the sun gears and also to rotate about their own central axes, simulating random movement.

One type of recreational area that has proven to be popular is a skating rink. For example, U.S. Pat. No. 4,838,825 (Hwang et al.) discloses a toy kiddieland wherein the display surface includes a skating rink, an undulating track and a play area that includes swings, all of which have figurines that are moved by the magnetic force of magnets. Beneath the display surface is a plate rotatably mounted on a base and equipped with a plurality of magnets. Magnets positioned beneath the skating rink are mounted in pairs on either end of a rotary shaft. The pairs of magnets revolve with the rotating plate and can also rotate about their respective shafts through attraction to a stationary magnet secured to the base of the display. Additional magnets are mounted on vertically movable shafts for moving figurines, such as cars, over the track, and magnets secured to the outer periphery of the plate move the swinging displays.

U.S. Pat. No. 2,645,880 (Richter) discloses another type of animated skating rink. In this patent, magnets are moved below the skating surface by an endless belt. A drive gear and a plurality of idler gears are provided to support and drive the belt in a tortuous path. Additional magnets are supported and driven in independent paths by a supplemental drive system, which also uses an endless belt.

A different type of toy is disclosed in U.S. Pat. No. 3,510,949 (Christy), wherein a figurine is moved over a flat surface in a geometric pattern. The figurine is equipped to hold a writing instrument for tracing its geometric path on a piece of paper placed on the flat surface. The drive mechanism in this patent utilizes a plurality of planetary gears rotatably mounted on a gear base and keyed to a stationary sun gear. A quadripole magnet is eccentrically mounted to each planetary gear. As the base rotates, the planetary gears revolve around the sun gear and rotate about their own axis to effect movement of the magnets.

However, the magnet drive systems discussed above, and those generally known, have certain limitations in the manner and patterns in which the magnets are driven. While these systems may be well suited for use in simulating the smooth, continuous movements of ice skating or auto racing, they are not particularly applicable to other not so continuous movements, such as rowing. Thus, an innovative magnet drive system, or mechanism, is desirable for providing unique movement of figurines over a display surface. In addition, it is desirable to provide an improved figurine configuration to contribute to the realism of the movements thereof.

SUMMARY OF THE INVENTION

It is a general object of the present invention to provide an animated display with improved movement of figurines over a display surface.

It is therefore an object of the present invention to provide a unique drive mechanism for driving magnets below a surface of an animated display device.

It is still another object of the invention to provide an improved figurine which interacts with the magnets to produce more animated motion.

It is yet another object of the invention to provide a magnet drive mechanism for driving a plurality of sets of magnets incrementally at different intervals.

It is another object of the invention to provide a figurine which translates the incremental magnet motion into simulated individual body movements as it is driven.

It is still another object of the invention to provide a figurine designed to move through water contained in the animated display and which is driven in a manner to simulate a rowing motion.

In accordance with one aspect of the invention, an animated display for use with magnetically-attractable, movable figurines comprises a display surface, first magnetic means for attracting one of the figurines across the display surface, and drive means for intermittently moving the first magnetic means in a closed path below the display surface.

Second magnetic means for attracting another of the figurines can be provided, wherein the drive means intermittently moves the second magnetic means asynchronously with the first magnetic means in a second closed path below the display surface. The first and second magnetic means can each be a magnet. A lateral side can be provided around the display surface, the lateral side cooperating with the display surface to form a basin capable of holding liquid so that the figurines are partially submerged when moving across the display surface.

In accordance with another aspect of the invention, an animated display for use with magnetically-attractable, movable figurines comprises a display surface and a first transmission wheel assembly supported below the display surface for rotation about an axis substantially normal to the display surface. The transmission wheel assembly has a circumferentially arranged first set of transmission teeth. A first arm is connected at a proximal end to the first transmission wheel assembly. First magnetic means for attracting one of the figurines across the display surface is disposed at a distal end of the first arm below the display surface. A rotatable drive wheel assembly is provided with a set of drive teeth arranged circumferentially thereon which intermittently engages the first set of transmission teeth on the first transmission wheel assembly as said drive wheel assembly rotates. Drive means is provided for driving the drive wheel assembly.

In yet another aspect of the invention, an animated display device for use with magnetically-attractable, movable figurines comprises a display surface with first and second transmission wheels supported below the display surface to be rotatable about a transmission axis substantially normal to the display surface. The first transmission wheel has a circumferentially arranged first set of transmission teeth, and the second transmission wheel has a circumferentially arranged second set of transmission teeth. A third transmission wheel is supported below the display surface to be rotatable about the transmission axis. The second transmission wheel is sandwiched between the first and third transmission wheels. Interconnection means is provided for maintaining a constant rotational relationship between the third and first transmission wheels so that the third and first transmission wheels rotate synchronously about the transmission axis.

This aspect of the invention further includes a first arm connected at a proximal end thereof to the third transmission wheel and a second arm connected at a proximal end thereof to the second transmission wheel. A first magnet is disposed at a distal end of the first arm adjacent the display surface. A second magnet is disposed at a distal end of the second arm adjacent the display surface.

A rotatable drive wheel assembly has at least two circumferentially arranged sets of drive teeth, each of the sets of drive teeth intermittently engaging one of the first and second sets of transmission teeth to drive the first and second transmission wheels as the drive wheel assembly rotates. The first and second sets of drive teeth are positioned relative to one another so that the drive wheel assembly drives the first and second transmission wheels asynchronously.

According to another aspect of the present invention, an animated display comprises a display surface and a plurality of figurines movable over the display surface. A first transmission wheel is supported below the display surface to be rotatable about a transmission axis substantially normal to the display surface, and has a circumferentially arranged first set of transmission teeth. A second transmission wheel is supported below the display surface to be rotatable about the transmission axis and has a circumferentially arranged second set of transmission teeth. A third transmission wheel is also supported below the display surface to be rotatable about the transmission axis. The second transmission wheel is sandwiched between the first and third transmission wheels. Interconnection means is provided for maintaining a constant rotational relationship between the third and first transmission wheels so that the third and first transmission wheels rotate synchronously about the transmission axis.

In this aspect, a first arm is connected at a proximal end to the third transmission wheel, and a second arm is connected at a proximal end to the second transmission wheel. First magnetic means for attracting one of the figurines is disposed at a distal end of the first arm below the display surface, and second magnetic means for attracting another of the figurines is disposed at a distal end of the second arm below the display surface.

A rotatable drive wheel assembly has at least two circumferentially arranged sets of drive teeth. Each of these sets of drive teeth intermittently engages one of the first and second sets of transmission teeth to drive the first and second transmission wheels as the drive wheel assembly rotates. The first and second sets of drive teeth are positioned relative to one another so that the drive wheel assembly drives the first and second transmission wheels asynchronously.

Each of the figurines comprises (i) a base, (ii) a lever fulcrumed to the base, and (ii) an attractive element magnetically attractable to the first and second magnet means disposed at a lower end of the lever.

According to yet another aspect of the present invention, a figurine capable of simulating movement across a display surface comprises a figurine housing, a base secured in the housing, a lever pivotally secured to the base, a magnetically attractive element secured at one end of the lever, and a figure secured to an opposite end of the lever.

Accordingly, the present invention provides a magnetic drive system that causes at least one group of figurines to move in seemingly independent, intermittent motion. In addition, the figurines are configured to translate the intermittent motion into simulated body movements, thereby simulating real-life motion.

These and other objects, aspects, features and advantages of the present invention will become apparent from the following detailed description of the preferred embodiments taken in conjunction with the accompanying drawings.

DESCRIPTION OF THE PREFERRED EMBODIMENTS

Figure 1:
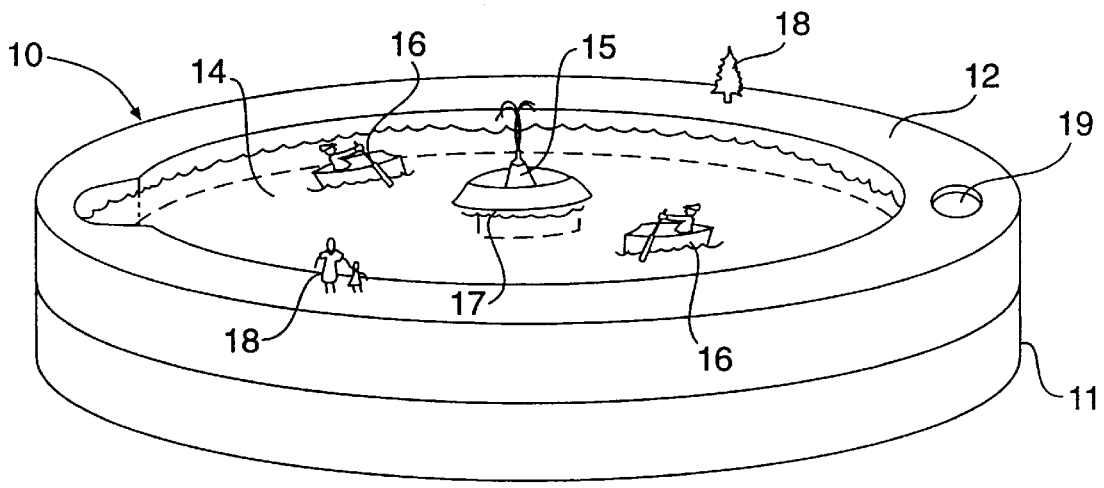
FIG. 1 is a perspective view of an animated display device in accordance with a preferred embodiment of the invention, showing a platform of the display device.

FIG. 1 is a perspective view of a first embodiment of an animated display device 10 in accordance with the present invention. As shown in this figure, the animated display device 10 includes a base 11 and a platform 12. The platform is provided with a display surface 14 on which mobile figurines 16 are placed. The display surface 14 is preferably recessed in the platform to form a basin that can be filled with water so that the display surface is submerged, creating a "pond."

Generally, the mobile figurines 16, which are partially submerged in the water, are maneuvered over the display surface 14 by a magnetic force supplied by magnets supported beneath the display surface and moved by a drive mechanism that will be discussed in detail below. The drive mechanism is capable of moving the figurines, which in one non-limiting example are row boats, in an intermittent manner to simulate a rowing motion.

In addition to the figurines, a plurality of stationary FIG. 18 and other types of displays such as trees, benches, animals, a bridge, and the like, can be provided on the platform.

The platform 12, including the display surface 14, can be formed of a thin layer of non-magnetic, water-resistant material such as plastic, and is preferably a one-piece molded article. As shown in FIG. 1, the platform is formed to include a fountain 15 in the center of the pond.

A conventional pump (not visible in this view) is contained below the fountain and operates to squirt water through the fountain into the air. The water falls into the "pond" covering the display surface 14. The water level itself should be maintained at a predetermined level, dependent primarily on the design of the figurines, as discussed below. A fill line (not shown) can be provided at this desired level as a guide to the user. An overflow trough 17 is provided directly beneath the fountain and surrounding the pump at the desired fill level so that excess water is recycled through the pump. If the water level is too low, none will be recycled through the trough 17. Therefore, a tank is provided beneath the platform to hold a reserve supply of water for the pump, helping maintain the water at the desired level. The tank is filled through a port 19 in the platform.

Figure 2:
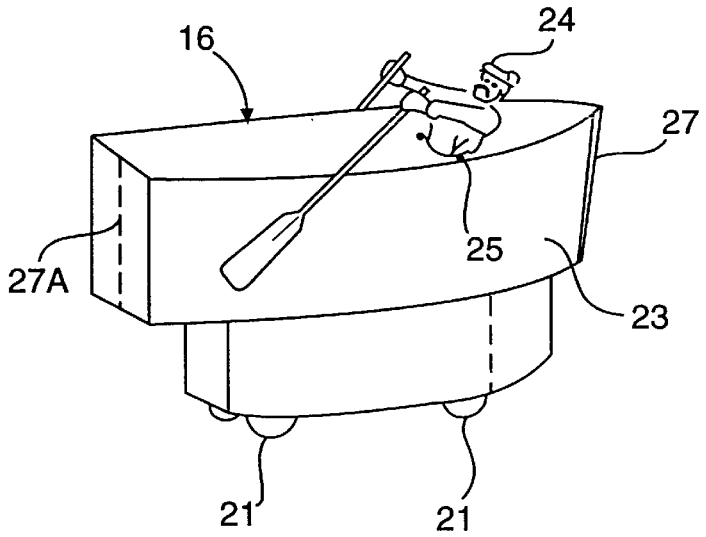
FIG. 2 is a perspective view of a figurine in accordance with the preferred embodiment of the present invention.

As shown in FIG. 2, each mobile FIG. 16, or figurine, in this preferred embodiment, includes a boat 23 and an action FIG. 24 pivotally connected to the boat 23 by a pivot 25. The boat 23 is buoyant and dimensioned to lightly rest on the display surface 14 when the pond is filled to the fill line. The boat 23 has a set of wheels 21 (preferably four) to reduce the effects of friction as the figurine 16 moves across the display surface 14.

Figure 3A:
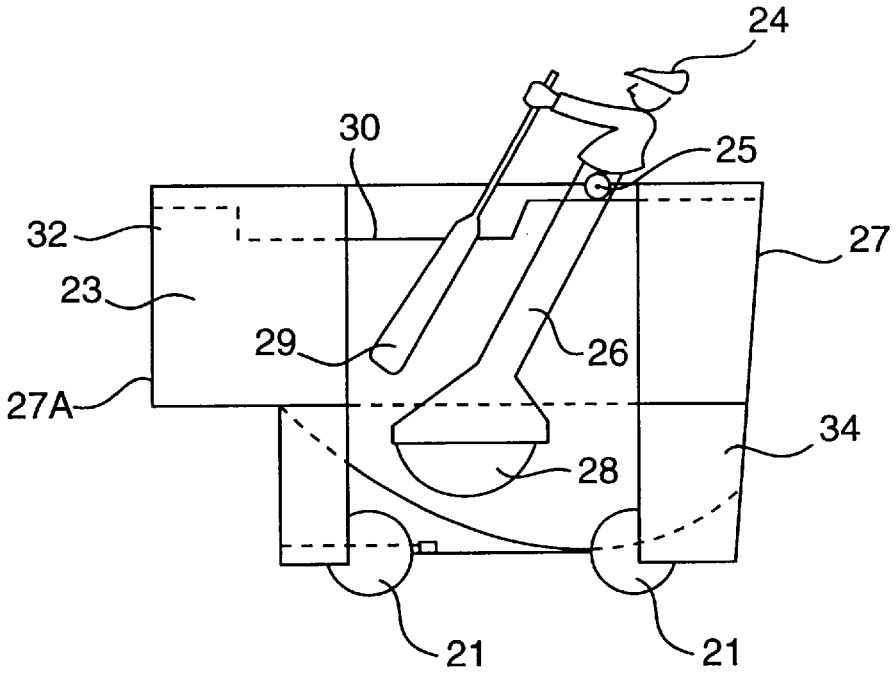
FIG. 3A is a partial cut-away elevational view of the figurine of the animated display device in accordance with the preferred embodiment of the present invention.

As can be seen in the partial cutaway view of the figurine in FIG. 3A, the action FIG. 24 extends from a lever arm 26 which is concealed by the body of the boat 23. A figure magnet 28 is disposed at the distal end of the lever arm 26. In this embodiment, the boat 23 includes three separate parts: a floorboard 30, a main hull 32, and an exterior hull 34. As can be seen, the action-figure 24 is connected by the pivot 25, and the lever arm 26 extends down from the pivot 25 through the floorboard 30.

The figure magnet 28 is encased in the main hull 32 and can swing freely on the lever arm 26 through an arc within the confines of the main hull 32. As the magnet 28 swings on the lever arm 26, the action FIG. 24 will likewise swing above the floorboard 30. In this embodiment, because the action FIG. 24 and the lever arm 26 are on opposite sides of the pivot 25, as one swings forward, i.e. toward the "bow" 27 of the boat 23, the other will swing back, and vice versa.

The arc through which the magnet 28 swings can be determined by the dimensions of the magnet 28, the lever arm 26, and the inside of the main hull 32, whereby the magnet 28 will contact the inside of the main hull 32 at either end of its arc. Alternately, the action FIG. 24 or the lever arm 26 can be configured to contact the floorboard 30 at either or both ends of the arc. The degree to which the magnet 28 should be allowed to swing is dictated primarily by the desired limits of the rowing motion that the action FIG. 24 is meant to simulate, as discussed below. In other words, the magnet 28 and the action FIG. 24 will be allowed to pivot to a degree appropriate for the desired visual effect.

As will be seen, the action FIG. 24 is propelled forward by the magnetic attraction between the magnet 28 and a drive magnet which is below the display surface 14. Therefore, it is desirable to have this magnetic attraction be at its maximum when the magnet 28 is in its forward-most position on its arc. Thus, it is preferable that the main hull 32 be configured to stop the forward swing of the magnet 28 at a point at which the lever arm 26 is near vertical, so that the magnet 28 will therefore be at its lowest point.

In the preferred embodiment, the action FIG. 24 simulates a rowing motion. As the magnet 28 swings back and forth on the lever arm 26, the action FIG. 24 will reciprocate above the pivot 25 at the "waist" of the action figure. This reciprocation, when combined with the oars 29 held by the action figure, gives the impression of a person rowing a boat.

It should be noted that the principles of the present invention can be applied, however, to any of a number of other simulated motions, such a roller skating, skateboarding, cross-country skiing, or the like. If desired, the magnet need not be concealed in the base of the figurine 16, as in the preferred embodiment, nor must the action figure reciprocate opposite the magnet.

Figure 3C:
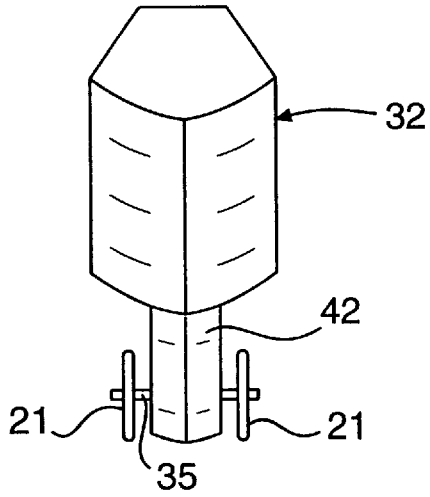
FIG. 3C is a front perspective view of a portion of the figurine of the animated display device in accordance with the present invention.
Figure 3B:
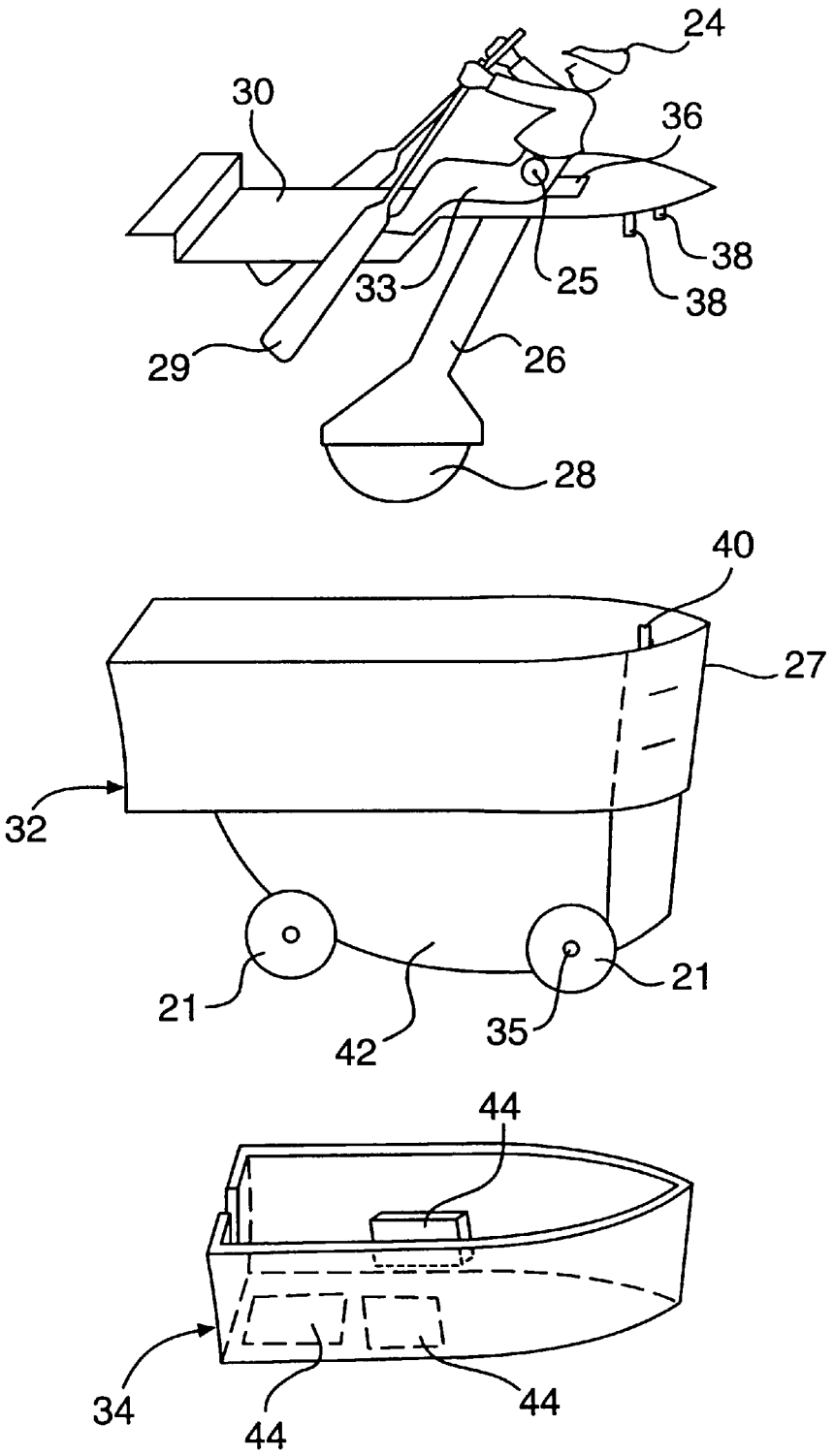
FIG. 3B is an exploded, perspective view of the figurine of the animated display device in accordance with the present invention.

FIG. 3B is an exploded view of the mobile FIG. 16. The action FIG. 24 is pivotally connected by the pivot 25, e.g. pins, to the floorboard 30. More particularly, in this embodiment the floorboard includes an integrally-formed member 33 shaped to resemble legs and a lower torso of the action FIG. 24.

FIG. 3B also shows the lever arm 26 extending through an opening 36 in the floorboard 30. To facilitate proper assembly, the floorboard 30 can be provided with insertion tabs 38 which mate with insertion holes 40 in pegs extending up within the main hull 32.

The main hull 32 is preferably formed of molded plastic or a like material, and is buoyant with a water-tight underside 42 in the preferred embodiment in which the display surface 14 is submerged. The wheels 21 are rotatably attached to pins 35 extending from the main hull 32.

The exterior hull 34, which is also preferably molded plastic, fits over the underside 42 of the main hull 32. As best seen in FIG. 3C, the underside 47 is narrower than the remainder of the main hull 32. The exterior hull 34 holds the wheels 21 in place, and effectively conceals them from view when the figurine 16 is on the display surface 14. Much of the bottom of the exterior hull 34, which cannot be seen in this view, is open so that the wheels 21 can extend therethrough and so that the exterior hull 34 will not retain water. On the bottom (near the rear) and the sides of the inside of the exterior hull, non-magnetic weights 44 (preferably formed of lead or another suitably heavy, non-magnetic, corrosion-resistant material) are provided as ballast to help stabilize and keep the mobile FIG. 14 upright.

Although included in the preferred embodiment, the wheels 21 are not necessary to the invention. When partially submerged in water, the buoyancy of the main hull 32 will reduce the drag on the figurine 16 as it moves along the display surface 14. If no wheels are provided, then the exterior hull 34 becomes superfluous. In that case, the underside 42 of the main hull 32 could be flattened, and the weights 44 could be disposed therein instead. However, the wheels 21 do allow the figurine 16 to operate better in varying depths of water, whereas a wheel-less figurine would be more apt to become "stuck" by the forces of friction in shallow water.

Figure 4:
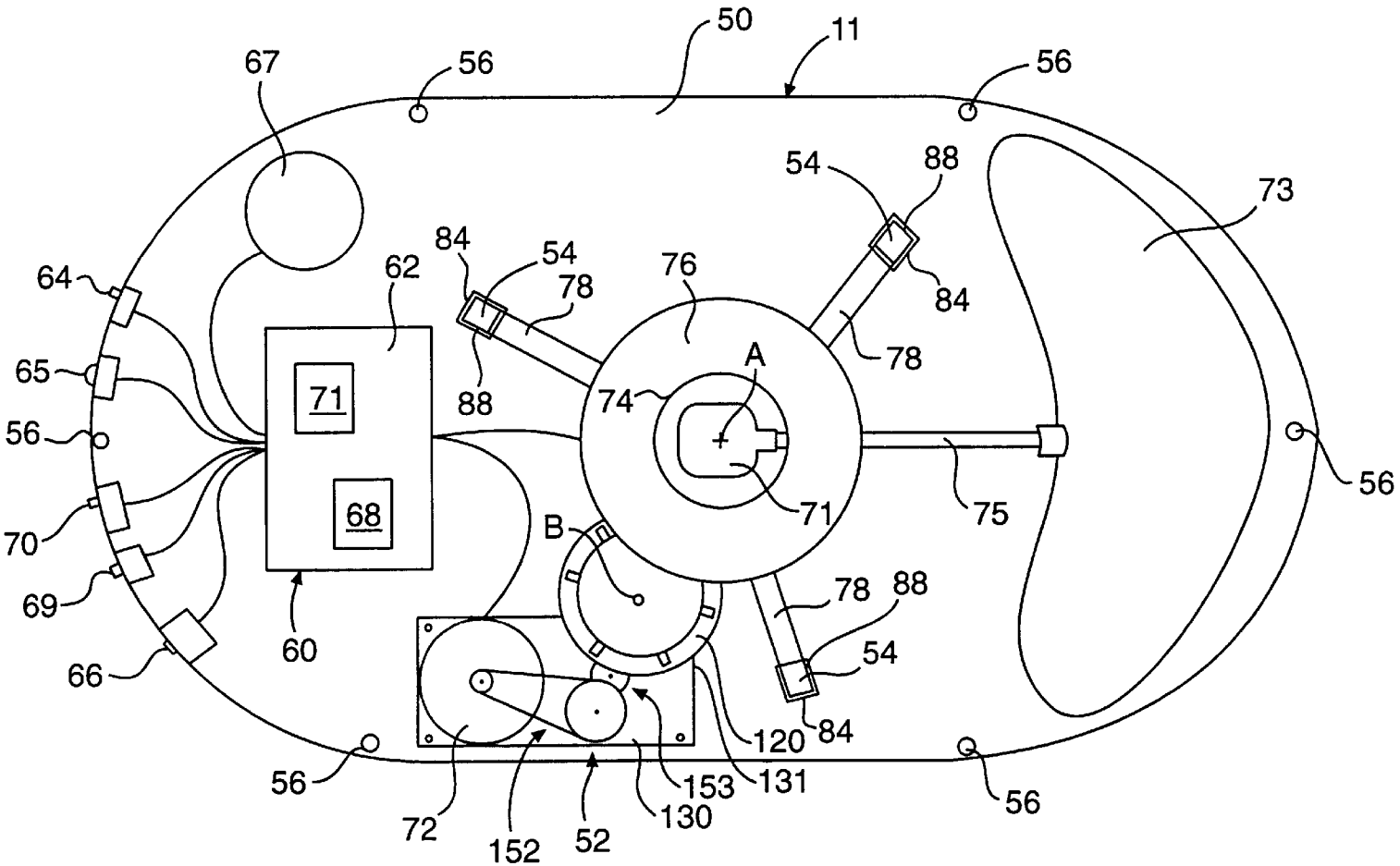
FIG. 4 is a top plan view of the display device, with the platform removed, in accordance with a preferred embodiment of the present invention.

FIG. 4 is a top view of the display device of the first embodiment with the platform removed, thus exposing an interior surface 50 of the base 11 and showing, among other items, a drive mechanism 52 for operating a plurality of magnets 54 to move the figurines. The base supports and houses the components necessary to operate the animated display device. The base itself is ideally formed of a single piece of molded plastic, and provided with a plurality of integrally-formed posts 56 for supporting and receiving the platform 12 by conventional fixing means such as press-fit or snap-fit engagement with corresponding elements on the underside of the platform 12.

Turning now to the components supported on the base, a controller 60 for operating the display device includes a control board 62, an on/off switch 64, a volume control 65 and a female adapter 66 for receiving an electrical cord supplying AC power to the controller. The control board is capable of playing music as the figurines "row," that is, move, on the platform, and in that regard includes a CPU 68 with a memory for storing, among other information, a plurality of songs. In addition, a speaker 67 is provided to output the music. A music switch 70 can be switched to select a new series songs, and a song switch button 69 can be used to skip to another song in the series. In this embodiment, a rotary volume switch 65 is provided to easily adjust the volume of the music or turn it off completely.

Preferably, the control board includes a conventional AC to DC converter circuit 71 for supplying DC current to the CPU to play music, and also to a motor 72 for operating the drive mechanism 52. In this regard, a DC motor is best suited for actuating the drive mechanism.

As will be appreciated, each of the elements shown in block outline in FIG. 4 is well known, and a specific type of construction is not critical to carrying out the invention or to a disclosure of the best mode for carrying out the invention.

The drive mechanism 52 for moving the magnets in the first embodiment of the invention is disposed directly beneath the display surface and will be described with reference to FIGS. 4, 5A, 5B and 6A–6C.

As seen in these figures, the drive mechanism features a gear system for supporting and moving a plurality of magnets 54. The gear system includes a central cylindrical gear support 74, about which a plurality of concentric, vertically-stacked gear elements 76 rotate about an axis A, extending up from the base 50. The gear support 74 can be either molded as an integral part of the base 50, or it can be a separate piece affixed to the base 50 in any conventional manner such as bonding, clamping, or riveting.

A pump 71, which can be a standard water pump supported in the platform 12, fits into the opening in the cylindrical gear support 74. The pump draws water as necessary from a water tank 73, as discussed earlier, via a tube 75, which fits through an opening either through the base 50 or the gear support 74 near the point of contact therebetween.

In the view of FIG. 4, only the top-most of the plurality of gear elements 76 is visible. Magnet arms 78 extend from these gear elements 76. In this embodiment, three arms 78 are provided. Preferably, the arms are symmetrically spaced from each other, which in this embodiment would result in the arms being spaced approximately 120° apart, on average. The spacing is discussed as an average because, as will be seen, these arms will not retain a constant separation.

At the terminal end of each arm 78 is a magnet support 84. The magnets 54 are placed in depressed pockets 88 of the magnet supports 84 and can be secured therein by glue or other comparable means if desired.

Figure 5A:
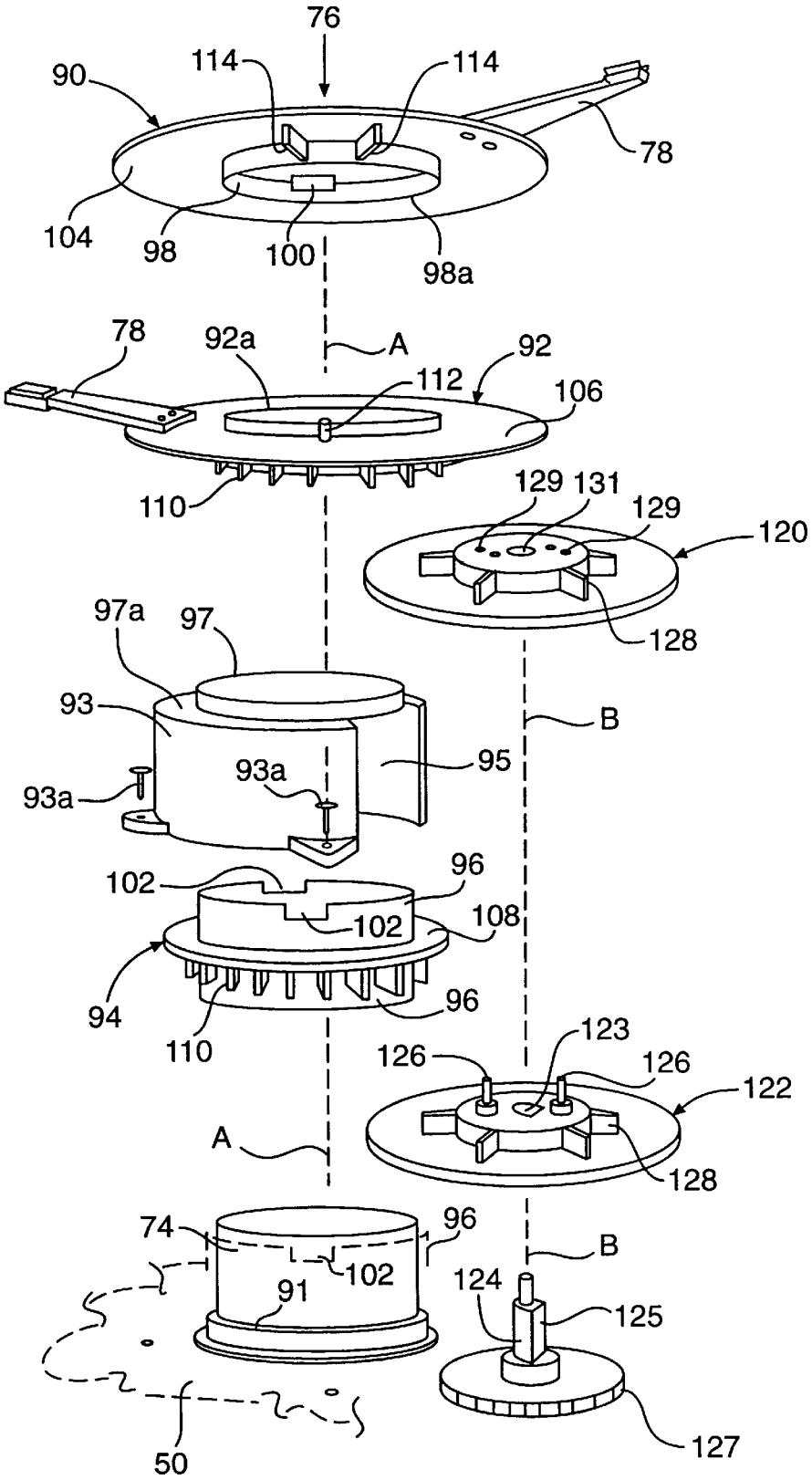
FIG. 5A is an exploded, perspective view of a drive mechanism in accordance with the preferred embodiment of the invention.

As best seen in FIG. 5A, the plurality of gear elements 76 include an upper transmission wheel 90, a middle transmission wheel 92, and a lower transmission wheel 94. The lower transmission wheel 94 has a cylindrical sleeve 96 with an upwardly extending portion which extends through the middle transmission wheel 92. The lower transmission wheel 94 itself fits over the gear support 74 like a sleeve, with a downwardly extending portion of the sleeve 96 resting on a ridge 91 at the base of the support 74. An overcap 93, which is secured to the base 50 by a set of rivets 93*a* or by any other acceptable means, retains the lower transmission wheel in position. The upwardly extending portion of the sleeve 96 of the lower transmission wheel extends out through a collar 97 of the overcap 93. The middle transmission wheel 92 fits over the collar 97 like a sleeve and sits on an annular ledge 97*a* of the overcap 93. A window 95 in the overcap allows the lower transmission wheel to be accessed and engaged, as discussed below.

The upper transmission wheel 90 has a downwardly extending cylindrical skirt 98 which fits over the sleeve 96 of the lower transmission wheel 94. Tabs 100, on the inner surface of the skirt 98, engage matching notches 102 on the upper edge of the sleeve 96.

Figure 5B:
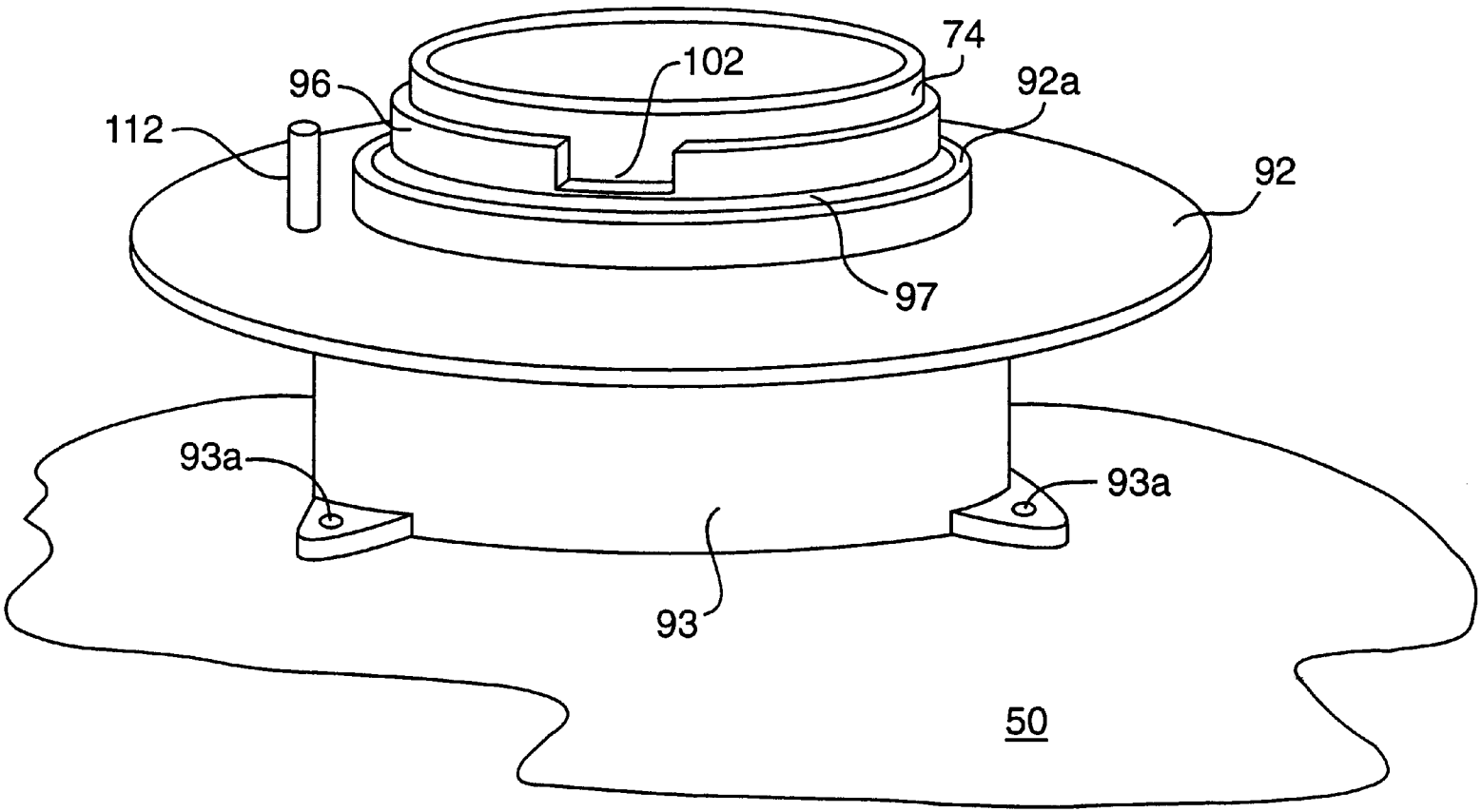
FIG. 5B is a partially-assembled perspective view of the drive mechanism shown in FIG. 5A, and FIGS. 6A–6C are schematic top plan views of a portion of the drive mechanism in accordance with the preferred embodiment of the invention.

FIG. 5B shows the plurality of gear elements 76 with the upper transmission wheel 90 removed. As shown in FIG. 5B, the notches 102, an upper rim 92*a* of the middle transmission wheel, and the collar 97 preferably sit at approximately the same elevation when the lower transmission wheel 94, overcap 93, and middle transmission wheel 92 (without any arms attached in this illustration) are all in place on the gear support 74. Therefore, the weight of the upper transmission wheel can rest on the lower transmission wheel through the tabs 100, or a bottom surface area of the skirt 98 can rest on either the upper rim 92*a* of the middle transmission wheel 92 or (as in the preferred embodiment) on the collar 97 of the overcap 93. In any case, the lower and upper transmission wheels 94, 90, which sandwich the middle transmission wheel 92, are linked by this tab/notch engagement and rotate synchronously about gear support 74. Part of the cylindrical sleeve 96 and notches 102 of the lower transmission wheel 94, are shown above positioned on the gear support 74 in phantom lines in FIG. 5A.

The middle transmission wheel 92 rotates freely about the sleeve 96 of the lower transmission wheel 94. Thus, the middle transmission wheel 92 rotates about the gear support 74 independently of the upper and lower transmission wheels 90, 94. However, this independent rotation is limited to a predetermined range as discussed below.

With reference to FIG. 5A in particular, each of the transmission wheels 90, 92, 94 has an annular flange 104, 106, 108, respectively. An appendage 112 extends upward from the upper side of the flange 106 of the middle transmission wheel 92. On the underside of the flange 104 of the upper transmission wheel 90 are a pair of radially-extending ribs 114. The appendage 112 of the middle transmission wheel 92 sits between the ribs 114 of the upper transmission wheel 90, which serves two purposes. First, during assembly of the display device 10, the appendage 112 and ribs 114 serve as a guide for setting the relative juxtaposition of the upper and middle transmission wheels 90, 92 to establish an acceptable spacing of the arms 78. Second, the ribs 114 will retain the appendage 112 therebetween, preventing the middle transmission wheel 92 from slipping relative to the upper transmission wheel 90 during operation, thereby maintaining the spacing of the arms 78.

On the underside of the flanges 106, 108 of the middle and lower transmission wheels 92, 94 are matching sets of radially-extending teeth 110. Both transmission wheels 92, 94 should have the same number of teeth 110 spaced about its circumference. These teeth 110 are the mechanism by which the plurality of gear elements 76 are driven, as discussed more fully below.

A pair of drive wheels 120, 122 are provided to drive the transmission wheels 90, 92, 94. The upper drive wheel 120 and the lower drive wheel 122 are very similar in construction. Each is rotated by the rotational force of a drive axle 124, which extends from and is driven by a drive gear 127. The lower drive wheel 122 has a non-circular opening 123 to match the non-circular portion 125 of the drive axle 124. Thus, drive axle 124 directly drives the lower drive wheel 122. A set of pins 126, which extend from the lower drive wheel 122, fits through a matching set of holes 129 in the upper drive wheel 120, holding the two drive wheels 120, 124 in constant angular juxtaposition. Thus, rotation of the lower drive wheel 122 rotates the upper drive wheel 120. In this manner, the upper and lower drive wheels rotate simultaneously about an axis B.

The upper drive wheel 120 can also have a non-circular opening to match and be driven directly by the drive axle 124. However, in the preferred embodiment illustrated, the opening 131 is circular so that the upper drive wheel 120 can be set in any angular position relative to the drive axle 124. In this case, multiple sets of holes 129 can be provided in the upper drive wheel 120 for receiving the pins 126, permitting the upper and lower drive wheels 120, 122 to be set in varying angular relationships.

The drive gear itself is driven, either directly or indirectly, by the motor 72 to rotate the drive axle 124. The arrangement in FIG. 4 shows a spindle/endless-belt arrangement 152 and a gear train 153 for conveying the rotatable force from the motor 72 to the drive gear 127. Of course, comparable arrangements can be used for effecting rotation of the drive gear 127 without departing from the scope of the invention.

The upper and lower drive wheels 120, 122 are each provided with a matching set of radially-extending teeth 128 that engage the teeth 110 of the middle and lower transmission wheels 92, 94, respectively. The upper and lower drive wheels 120, 122 have the same number of teeth 128 spaced about their perimeters, but the pins 126 of the lower drive wheel 122 and the holes 129 of the upper drive wheel 120 are intentionally positioned so that the teeth 128 of one drive wheel are not aligned vertically with the teeth 128 of the other.

As discussed, the drive wheels 120, 122 are driven simultaneously at a constant rotational speed by the motor 72. The teeth 128 are spaced about the circumference of the drive wheels 120, 122 with a relatively wide pitch in comparison to the teeth 110 of the middle and lower transmission wheels 92, 94. As the drive wheels 120, 122 rotate, only one of the teeth 128 of the upper drive wheel 120 will contact the teeth 110 of the middle transmission wheel 92 at any given time, and there will not be continuous contact between the sets of teeth 128, 110.

In this manner there will be an interval between the moment that a tooth 128 disengages and the moment the next tooth engages the teeth 110 of the middle transmission wheel. The same is true for the engagement between the lower drive wheel 122 and the lower transmission wheel 94. Thus, there will be intervals in which the teeth 128 of the drive wheels 120, 122 do not drive the teeth 110 of the middle and lower transmission wheels 92, 94. Therefore, the drive wheels do not drive the middle and lower transmission wheels in a continuous fashion. Rather, the rotations of the middle and lower transmission wheels are intermittent, alternating between rotation and rest.

Furthermore, because in this embodiment the teeth 128 of the respective drive wheels 120, 122 are not aligned with one another, the middle and lower transmission wheels 92, 94 will not be driven simultaneously. Rather, the middle and lower transmission wheels 92, 94 will be driven alternately. The lower drive wheel 122 drives the lower transmission wheel 94—and therefore the upper transmission wheel 90, which is interlocked with the lower transmission wheel 94 (as discussed earlier), when the teeth 128 of the lower drive wheel 112 engage the teeth 110 of the lower transmission wheel 94. As discussed, this movement will occur in regular intervals because of the relative spacing between the teeth 110 and teeth 128. Likewise, the upper drive wheel 120 will drive the middle transmission wheel 92 when their respective teeth engage intermittently. Because the teeth 128 of the upper and lower drive wheels 120, 122 are not aligned, these intermittent periods of revolution will not coincide. However, because the middle and lower transmission wheels 92, 94 have the same number of teeth 110 and the drive wheels 120, 122 have the same number of teeth 128, the middle, and lower transmission wheels 92, 94 will rotate at the same average rate, i.e., they will have the same period of rotation. Thus, the middle and lower transmission wheels 92, 94 will retain the same average rotational juxtaposition throughout repeated rotations.

While not essential to the operation of the present invention, it is preferred that the teeth 110, 128 be evenly dispersed about the perimeters of the transmission wheels 92, 94 and the drive wheels 120, 122, respectively. This helps to assure that the arms 78 will maintain an appropriate spacing during the entirety of each revolution.

It should also be noted that the upper and lower drive wheels 120, 124 can be combined into a single assembly having two or more sets of teeth. This would, of course, eliminate the flexibility to vary the angular relationship of the wheels.

As discussed above, the drive mechanism 52 can include a gear train with one or more intermediate gears between the motor 72 and the drive gear 127. The drive gear can be powered by the motor 72, which is preferably a DC motor, although an AC motor could also be used. Any of a number of alternate means can be employed to rotate the drive gear, such as an endless belt and pulley arrangement or a conventional spindle rotated directly by the motor, without departing from the scope of the invention.

In this embodiment, most of the gear train is disposed in a gear box 130 as shown in FIG. 4 and reaches the drive gear 127 through the gear box's open sides 132. In addition, the motor 72 is supported on the gear box 130.

Operation of the drive mechanism is initiated by the supply of power to the motor 72 by turning on the on/off switch 64. As discussed above, the motor 72 drives the drive axle 124 via the drive gear 127, which in turn drives the upper and lower drive wheels 120, 122. The upper and lower drive wheels 120, 122 drive the middle and lower transmission wheels 92, 94 intermittently. The upper transmission wheel 90 is driven synchronously with the lower transmission wheel 94. The magnets 54 at the end of the arms 78 are intermittently driven in circular patterns about the upper and middle transmission wheels 90, 92.

FIG. 5A shows only one arm 78 attached to each of the upper and middle transmission wheels 90, 92 by means of screws, rivets, bonding or the like. However, FIG. 4 shows three arms 78, which is preferable. Thus, an additional arm is attached to either one of the upper or middle transmission wheels 90, 92. In actuality, any number of arms (including only one) and magnets can be utilized. The transmission wheels 90, 92 can be provided with multiple holes (not shown) around their perimeters to accommodate many arms 78 or so that the arms 78 can be repositioned thereon.

If at least one arm 78 is attached to each of the upper and middle transmission wheels 90, 92, then the magnets 54 of those arms will move intermittently and not simultaneously. This asynchronous movement will lend to the impression that the figurines 16 are moving independently of one another.

Figure 6A:
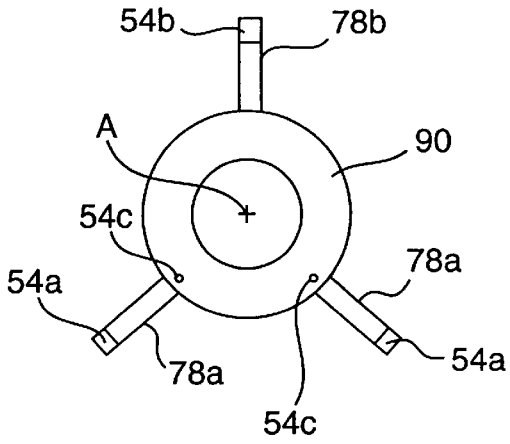
Figure 6B:
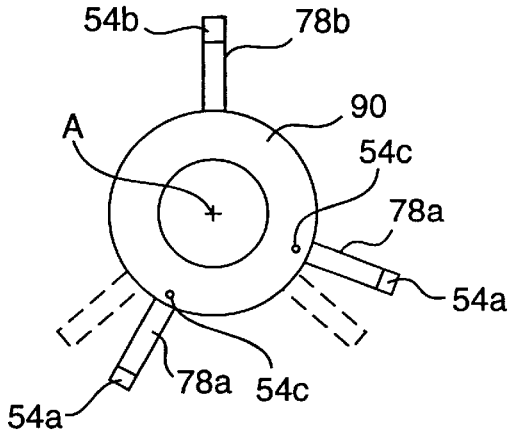
Figure 6C:
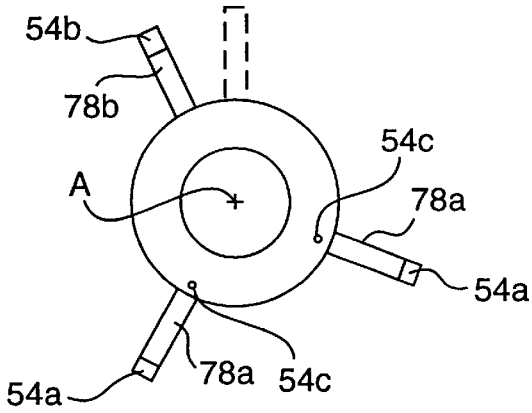

The asynchronous, intermittent motion is illustrated in FIGS. 6A through 6C, which show a schematic top view of the operation of the drive mechanism at successive points in time. In these figures, only the upper transmission wheel 90 is visible, as the middle and lower transmission wheels 92, 94 are disposed directly beneath and obscured by the upper transmission wheel 90. Two arms 78*a*, each with a magnet 54*a* at its distal end, are affixed at their proximal ends to the upper transmission wheel by (in this example) screws 54*c*. An arm 78*b* is affixed to the middle transmission wheel. A magnet 54*b* is disposed at the distal end of the arm 78*b*.

In FIG. 6A, first in time, the three arms 78*a*, 78*b* are relatively evenly distributed about the common axis A of the transmission wheels.

Turning to FIG. 6B, next in time, it can be seen that the arms 78*a* have moved counter-clockwise about axis A (from the FIG. 6A position, shown here in phantom lines), while the arm 78*b* has remained still. To create this movement, the lower drive wheel 120 has driven the upper transmission wheel 90 counter-clockwise via the lower transmission wheel. In this non-limiting example, all of the arms 78*a*, 78*b* are stationary at this moment in time because the teeth of the upper drive wheel have disengaged from the teeth of the middle transmission wheel, and the teeth of the lower drive wheel have not yet engaged the teeth of the lower transmission wheel.

Next, in FIG. 6C, the arm 78*b* has rotated counter-clockwise (from its original phantom-line position in FIG. 6A), while the arms 78*a* remain stationary, re-establishing the original spacing amongst the arms 78*a*, 78*b*. This is because the upper drive wheel has engaged and driven the middle transmission wheel. Meanwhile, the lower drive wheel has not yet re-engaged the lower transmission wheel, so the upper transmission wheel 90 has remained stationary.

As can be seen, FIGS. 6A through 6C show the magnets 54*a*, 54*b* intermittently making their way around a path encircling axis A. It should be noted that the drive wheels and transmission wheels can be designed so that the periods of motion of the transmission wheels (and arms) overlap. For example, the lower drive wheel can engage the lower transmission wheel before the upper drive wheel disengages from the middle transmission wheel, or vice versa, so that there is some coincidental motion, but not completely in synch.

As the magnets 54 are driven in intermittent, circular paths beneath the display surface 14, the figurines 16 will be drawn by magnetic attraction across the display surface 14 above. As the magnet 54 stops and starts, the figurine magnet 28 and the figurine 16 will be drawn along in disjointed motions that combine to create the impression that the action FIG. 24 is rowing the boat 23, as described below.

When the drive magnet 54 moves below the display surface in a direction from the "stern" 27A of the boat 23 toward the "bow" 27, the figure magnet 28 will be drawn forward. This rocks the action FIG. 24 toward the stern, so it appears to bend at the waist and press the oars. When the figure magnet 28 reaches the front of its arc, the figurine 16 is forced to follow the drive magnet 54, driving the boat 23 forward. When the magnet 54 stops, the momentum of the figurine 16 continues forward until the draw of the drive magnet 54 and the drag of friction stop it. In the meantime, however, the figure magnet 28 stops with the drive magnet 54. Therefore, as the boat 23 continues its forward motion, the figure magnet 28 swings toward the stern 27 of the boat. This forces the action FIG. 24 to rock toward the bow of the boat 23, appearing to straighten and pull the oars.

If the frictional forces are small enough, once the figurine 16 stops its forward motion, the draw between the magnets 28, 54 may force the figurine 16 backward so that the figure magnet 28 can swing down again through its arc toward the bow 27 of the boat 23 and closer to the drive magnet 54. In any event, once the drive magnet 54 moves forward again, the cycle will begin again, driving the figure magnet 28 forward in the figurine 16 (and thus the action FIG. 24 toward the stern) and the figurine 16 forward on the display surface 14. Thus, as the figurine 16 stops and starts through its circular path around the display surface 14, the action FIG. 24 will be rocking back and forth on the figurine 16, giving the impression of rowing the boat.

It should be noted that only one of the magnets 28, 54 need be an actual magnet. The other could be replaced by a metal to which the magnet is sufficiently drawn.

Of course, factors such as the size and weight of the figurines, the coefficient of friction between the platform surface and the base of the figurines, and the like, will be readily taken into consideration by those skilled in the art in selecting the proper strength and size of magnets for attracting the figurines over the platform in a reliable manner.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. An animated display for use with magnetically-attractable, movable figurines, comprising:

a display surface on which the figurines can be supported;

first and second magnetic means, below said display surface, each for attracting a different one of the figurines across said display surface; and drive means for intermittently moving each of said first and second magnetic means so as to circle an axis substantially normal to said display surface, said drive means moving said second magnetic means asynchronously with said first magnetic means.

2. The display of claim 1, wherein each of said first and second magnetic means is a magnet.

3. The display of claim 1, further comprising a lateral side around said display surface, said lateral side cooperating with said display surface to form a basin capable of holding liquid in which the figurines can be partially submerged when moved across said display surface.

4. The display of claim 1, wherein said drive means comprises:

a first transmission wheel supported below said display surface to be rotatable about a transmission axis substantially normal to said display surface, said transmission wheel having a circumferentially arranged first set of transmission teeth;

a second transmission wheel supported below said display surface to be rotatable about the transmission axis and having a circumferentially arranged second set of transmission teeth;

a third transmission wheel supported below said display surface to be rotatable about the transmission axis, said second transmission wheel being sandwiched between said first and third transmission wheels;

interconnection means for maintaining a constant rotational relationship between said third and first transmission wheels so that said third and first transmission wheels rotate synchronously about the transmission axis;

a first arm affixed at a proximal end thereof to said third transmission wheel, said first magnetic means being disposed at a distal end of said first arm below said display surface;

a second arm affixed at a proximal end thereof to said second transmission wheel, said second magnetic means being disposed at a distal end of said second arm adjacent said display surface; and a rotatable drive wheel assembly having first and second circumferentially arranged sets of drive teeth, said first and second sets of drive teeth intermittently engaging, respectively, said first and second sets of transmission teeth to drive said first and second transmission wheels as said drive wheel assembly rotates, said first and second sets of drive teeth being positioned relative to one another so that said drive wheel assembly drives said first and second transmission wheels asynchronously.

5. The display of claim 4, wherein said drive teeth are arranged so that when one of said drive teeth disengages from one of said sets of transmission teeth, time will elapse before a subsequent one of said drive teeth engages said one set of transmission teeth.

6. The display of claim 4, wherein said first and second sets of transmission teeth each comprise an equal number of transmission teeth evenly distributed about said first and second transmission wheel, respectively, said first and second sets of drive teeth each comprise an equivalent number of drive teeth evenly distributed about said drive wheel assembly, and said first and second sets of drive teeth are circumferentially askew relative to one another.

7. The display of claim 4, wherein the first set of drive teeth has a wider pitch than does the first set of transmission teeth, and the second set of drive teeth has a wider pitch than does the second set of transmission teeth.

8. The display of claim 4, wherein the transmission teeth and the drive teeth are spaced so that no two of the drive teeth of the same one of the first and second sets of drive teeth simultaneously engage either of the first and second transmission wheels.

9. The display of claim 4, wherein the first and second arms are affixed at their proximal ends, respectively, to the third and first transmission wheels.

10. The display of claim 9, wherein the first and second arms extend laterally from, respectively, the third and first transmission wheels.

11. An animated display for use with magnetically-attractable, movable figurines, comprising:

a display surface on which the figurines can be supported;

a first transmission wheel assembly supported below said display surface for rotation about an axis substantially normal to said display surface, said transmission wheel assembly having a circumferentially arranged first set of transmission teeth;

a first arm affixed at a proximal end thereof to said first transmission wheel assembly;

first magnetic means for attracting one of the figurines across said display surface, said first magnet means being disposed at a distal end of said first arm below said display surface;

a rotatable drive wheel assembly having a set of drive teeth arranged circumferentially thereon which intermittently engages said first set of transmission teeth on said first transmission wheel assembly as said drive wheel assembly rotates; and drive means for driving said drive wheel assembly.

12. The display of claim 11, further comprising:

a second transmission wheel supported below said display surface for rotation about the transmission axis and having a second set of transmission teeth arranged circumferentially thereon;

a second arm affixed at a proximal end thereof to said second transmission wheel; and second magnetic means for attracting another of the figurines across said display surface, said second magnetic means being disposed at a distal end of said second arm below said display surface, wherein said drive wheel assembly has a second set of drive teeth arranged circumferentially thereon which intermittently engages said second set of transmission teeth on said second transmission wheel as said drive wheel assembly rotates, said first and second sets of drive teeth being positioned relative to one another to asynchronously engage, respectively, said first and second sets of teeth on said first transmission wheel assembly and said second transmission wheel as said drive wheel assembly rotates.

13. The display of claim 12, wherein each of said first and second magnetic means is a magnet.

14. The display of claim 12, wherein said drive teeth are arranged so that when one of said drive teeth disengages from one of said sets of transmission teeth, time will elapse before a subsequent one of said drive teeth engages said one set of transmission teeth.

15. The display of claim 12, wherein said first and second sets of transmission teeth each comprise an equal number of transmission teeth evenly distributed about said first transmission wheel assembly and said second transmission wheel, respectively, said first and second sets of drive teeth each comprise an equivalent number of drive teeth evenly distributed about said drive wheel assembly, and said first and second sets of drive teeth are circumferentially askew relative to one another.

16. The display of claim 11, further comprising a lateral side around said display surface, said lateral side and said display surface cooperating to form a basin capable of holding liquid in which the figurines can be partially submerged when moved across said display surface.

17. The display of claim 11, wherein the set of drive teeth has a wider pitch than does the first set of transmission teeth.

18. The display of claim 11, wherein the transmission teeth and the drive teeth are spaced so that no two of the drive teeth simultaneously engage the first transmission wheel assembly.

19. The display of claim 11, wherein the first arm is affixed at its proximal end to the first transmission wheel assembly.

20. The display of claim 19, wherein the first arm extends laterally from the first transmission wheel assembly.

21. An animated display for use with magnetically-attractable, movable figurines, comprising:

a display surface;

a first transmission wheel supported below said display surface to be rotatable about a transmission axis substantially normal to said display surface, said first transmission wheel having a circumferentially arranged first set of transmission teeth;

a second transmission wheel supported below said display surface to be rotatable about the transmission axis and having a circumferentially arranged second set of transmission teeth;

a third transmission wheel supported below said display surface to be rotatable about the transmission axis, said second transmission wheel being sandwiched between said first and third transmission wheels;

interconnection means for maintaining a constant rotational relationship between said third and first transmission wheels so that said third and first transmission wheels rotate synchronously about the transmission axis;

a first arm connected at a proximal end thereof to said third transmission wheel;

a second arm connected at a proximal end thereof to said second transmission wheel;

a first magnet disposed at a distal end of said first arm adjacent said display surface;

a second magnet disposed at a distal end of said second arm adjacent said display surface; and a rotatable drive wheel assembly having at least two circumferentially arranged sets of drive teeth, each of said sets of drive teeth intermittently engaging one of said first and second sets of transmission teeth to drive said first and second transmission wheels as said drive wheel assembly rotates, said first and second sets of drive teeth being positioned relative to one another so that said drive wheel assembly drives said first and second transmission wheels asynchronously.

22. The display of claim 21, wherein said drive teeth are arranged so that when one of said drive teeth disengages from one of said sets of transmission teeth, time will elapse before a subsequent one of said drive teeth engages said one set of transmission teeth.

23. The display of claim 21, wherein said first and second sets of transmission teeth each comprise an equal number of transmission teeth evenly distributed about said first and second transmission wheels, respectively, said first and second sets of drive teeth each comprise an equivalent number of drive teeth evenly distributed about said drive wheel assembly, and said first and second sets of drive teeth are circumferentially askew relative to one another.

24. The display of claim 21, further comprising a lateral side around said display surface, said lateral side and said display surface cooperating to form a basin capable of holding liquid so that the figurines are partially submerged when moving across said display surface.

25. The display of claim 21, wherein the first set of drive teeth has a wider pitch than does the first set of transmission teeth, and the second set of drive teeth has a wider pitch than does the second set of transmission teeth.

26. The display of claim 21, wherein the transmission teeth and the drive teeth are spaced so that no two of the drive teeth of the same one of the first and second sets of drive teeth simultaneously engage either of the first and second transmission wheels.

27. The display of claim 21, wherein the first and second arms are affixed at their proximal ends, respectively, to the third and first transmission wheels.

28. The display of claim 27, wherein the first and second arms extend laterally from, respectively, the third and first transmission wheels.

29. An animated display comprising:

a display surface;

a plurality of figurines movable over said display surface;

a first transmission wheel supported below said display surface to be rotatable about a transmission axis substantially normal to said display surface, said transmission wheel having a circumferentially arranged first set of transmission teeth;

a second transmission wheel supported below said display surface to be rotatable about the transmission axis and having a circumferentially arranged second set of transmission teeth;

a third transmission wheel supported below said display surface to be rotatable about the transmission axis, said second transmission wheel being sandwiched between said first and third transmission wheels;

interconnection means for maintaining a constant rotational relationship between said third and first transmission wheels so that said third and first transmission wheels rotate synchronously about the transmission axis;

a first arm connected at a proximal end to said third transmission wheel;

a second arm connected at a proximal end to said second transmission wheel;

first magnetic means for attracting one of said figurines, disposed at a distal end of said first arm below said display surface;

second magnetic means for attracting another of said figurines, disposed at a distal end of said second arm below said display surface; and a rotatable drive wheel assembly having at least two circumferentially arranged sets of drive teeth, each of said sets of drive teeth intermittently engaging one of said first and second sets of transmission teeth to drive said first and second transmission wheels as said drive wheel assembly rotates, said first and second sets of drive teeth being positioned relative to one another so that said drive wheel assembly drives said first and second transmission wheels asynchronously, wherein each said figurine comprises (i) a base, (ii) a lever fulcrumed to said base, and (ii) an attractive element magnetically attractable to said first and second magnet means disposed at a lower end of said lever.

30. The display of claim 29, wherein each said figurine further comprises an action figure extending above said base from an upper end of said lever.

31. The display of claim 29, wherein said first and second magnetic means and said attractive element are each a magnet.

32. The display of claim 29, further comprising a lateral side around said display surface, said lateral side cooperating with said display surface to form a basin capable of holding liquid so that the figurines are partially submerged when moving across said display surface.

33. The display of claim 29, wherein the first set of drive teeth has a wider pitch than does the first set of transmission teeth, and the second set of drive teeth has a wider pitch than does the second set of transmission teeth.

34. The display of claim 29, wherein the transmission teeth and the drive teeth are spaced so that no two of the drive teeth of the same one of the first and second sets of drive teeth simultaneously engage either of the first and second transmission wheels.

35. The display of claim 29, wherein the first and second arms are affixed at their proximal ends, respectively, to the third and first transmission wheels.

36. The display of claim 35, wherein the first and second arms extend laterally from, respectively, the third and first transmission wheels.

* * * * *